US005351875A

United States Patent [19]

Rhine et al.

[11] Patent Number: 5,351,875

[45] Date of Patent: Oct. 4, 1994

[54] MIXING AND DISPENSING DEVICE

[75] Inventors: Steve Rhine, Canton, Mich.; Gordon Baker, Amelia, Ohio

[73] Assignees: Hydro Systems Company, Cincinnati, Ohio; Diversey Corp., Livonia, Mich.

[21] Appl. No.: 968,336

[22] Filed: Oct. 29, 1992

[51] Int. Cl.[5] ..... B67D 5/60

[52] U.S. Cl. ..... 222/132; 222/144.5; 222/148; 417/76

[58] Field of Search ..... 222/129, 132, 133, 144.5; 239/310; 417/76

[56] References Cited

U.S. PATENT DOCUMENTS

| | | | |
|---|---|---|---|
| 3,357,599 | 12/1967 | Douglas et al. | 222/144.5 |
| 3,540,625 | 11/1970 | Lambe | 222/133 |
| 3,612,355 | 10/1971 | Stucky | 222/144.5 X |
| 3,773,065 | 11/1973 | Mattox | 239/310 X |
| 4,171,070 | 10/1979 | Colgate et al. | 222/144.5 X |
| 4,991,625 | 2/1991 | Manganaro | 222/144.5 X |
| 5,044,520 | 9/1991 | Moisan | 222/144.5 X |
| 5,071,070 | 12/1991 | Hardy | 222/144.5 X |
| 5,135,173 | 8/1992 | Cho | 222/144.5 X |
| 5,174,503 | 12/1992 | Gasaway | 222/144.5 X |

OTHER PUBLICATIONS

"Streamline Series-Select Four Models 874 & 875-Select Four Plus Model 876", by Hydro Systems Company, Cincinnati, Ohio (1992).

"Streamline Series-Multiproduct Proportioners and Dispensers", by Hydro Systems Company, Cincinnati, Ohio (1991).

"New Product Developments: Dispnser Accessories", by Hydro Systems Company of Cincinnati, Ohio.

"Oasis Field Reference Manual", by Ecolab of St. Paul, Minn.

*Primary Examiner*—Andres Kashnikow
*Assistant Examiner*—Kenneth DeRosa
*Attorney, Agent, or Firm*—Weintraub, DuRoss & Brady

[57] ABSTRACT

A mixing and dispensing device which selectively mixes liquids has two filling stations. Each filling station uses water pressure to siphon the liquids from their source container through the valves to an eductor to mix the chemicals with water and, then, to receiving containers, At least one of the valves is constructed to reduce cross-contamination by reducing the surface area of the delivery system.

9 Claims, 4 Drawing Sheets

FIG 1
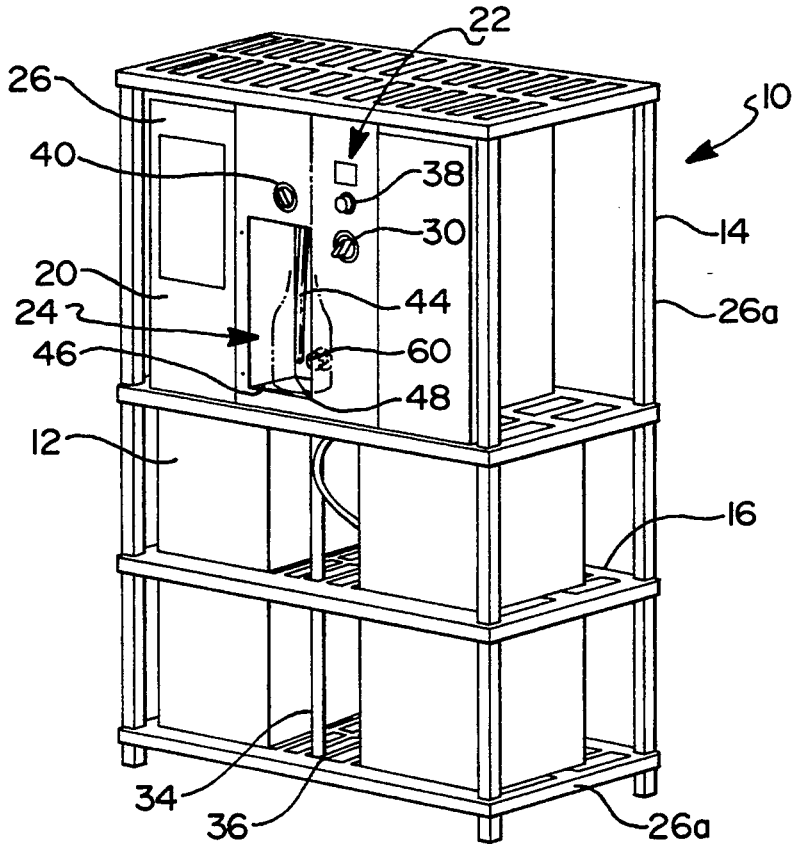
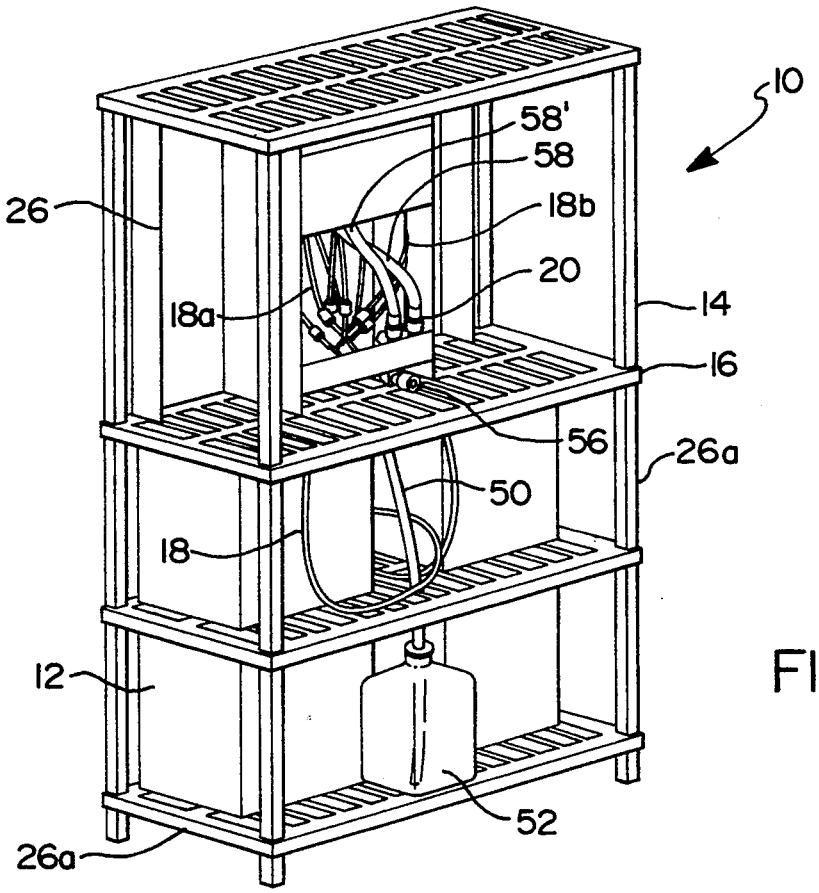
FIG 2

MIXING AND DISPENSING DEVICE

BACKGROUND OF THE INVENTION

1. Field of the Invention

This invention relates to devices for dispensing and mixing liquids, and more particularly to such devices that dispense and mix chemicals, and even more particularly to devices that dispense and mix cleaning chemicals.

2. Prior Art

Devices for dispensing and mixing cleaning chemicals have been recognized for several years as a major safety feature for personnel who are required to handle the chemicals. Such devices permit personnel to fill containers with cleaning products without having to come into physical contact with the chemicals that are mixed to produce the products. In addition to their safety features, these devices reduce waste and reduce spillage.

Typifying such dispensing and mixing devices is that commercially known as "Oasis" and which is distributed by Ecolab of St. Paul, Minn. The system is a single or multiple station fluid pressure operated device which dispenses to a three or five gallon mixing jug. This system is mountable on a shelf or a wall rack.

The "Oasis" device deploys a water gun, a metering device and a product concentrate tube which are assembled to and communicate with a filling jug. The product concentrate or cleaning chemical is brought to the jug through the concentrate tube. When the water gun is activated, the pressure created by the water draws the concentrate through the concentrate tube and the metering device and into the jug where it mixes with the water. After the jug is full, an operator can then fill a use solution container from a faucet or tap provided in the jug. In multiple filling stations, to prepare another cleaning chemical, the water gun is simply moved to another jug.

Processing one cleaning chemical at a time prevents cross-contamination. However, the movement of the water gun is time consuming and limits the system to processing only one chemical mixture at a time until the gun is moved to the next station. Generally, such a system is not capable of mixing and dispensing directly into a small sized container, such as a one-gallon container. Thus, there is a two-step process of mixing in one container, then dispensing into another container.

Another type of device used to mix and dispense chemicals is a siphon-type device such as that commercially made and marketed by Hydro Systems Company. Essentially, the system uses water flowing through a water valve and an eductor to draw a cleaning chemical to the educator. The water and cleaning chemical are mixed to a concentration based on the size of a metering tip disposed in the eductor. This device essentially comprises a source of water connected to a T-shaped educator, which, in turn, is in fluid communication with the source of chemical to be mixed with the water, As water flows through the eductor, it creates a vacuum, thereby drawing chemical thereinto which mixes with the water as it flows through the eductor and into a filling container. A manually operated gate, such as a spring-loaded shut-off controls the water flow through the eductor. This system eliminates the need to move a gun, but it still can only mix one chemical from a single source.

Another type of system, permitting up to four chemicals to be processed through one valve, is made and marketed by Hydro under the name "Streamline Select Four". In this system, up to four chemical sources are connected to the eductor via a single selector switch which functions as a valve. The selector switch selects the cleaning chemical to be mixed with water and is delivered therethrough to the eductor. However, the selector switch creates cross-contamination when it is changed from one chemical to another. The residue of the formerly processed chemical remains within the switch and mixes with the new chemical.

The cross-contamination is generally not a problem when filling large containers because the large amount of the new chemical significantly dilutes the former chemical. However, for small containers, such as one-gallon containers, the former chemical is usually not diluted sufficiently to meet quality and federal guidelines.

Moreover, other problems exist with present-day devices. For example:

(a) Excess operator handling to prevent cross-contamination when transferring from a large container to a small container;

(b) Selector-type systems are currently not usable for small containers because of cross-contamination;

(c) The known devices are primarily effective only when processing large volumes of cleaning products; and (d) Generally, multiple stations are required in order to handle multiple chemicals.

Thus, it is apparent that the use of the presently known selector switches to process multiple cleaning chemical sources are practical only for large containers. It would be desirable to provide a single system that incorporates the features of the selector switch for mixing cleaning product and filling both large and small containers with the product without cross-contamination of the small volume containers.

SUMMARY OF THE INVENTION

The mixing and dispensing system of the instant invention seeks to overcome the problems encountered with the prior art devices. The mixing and dispensing system or device hereof comprises:

(a) means for delivering water from a source thereof;

(b) plural sources of chemical to be mixed with the water;

(c) a first container filling station including:

1. a first selector switch valve;
2. an eductor in fluid communication with the selector switch valve and the means for delivering;
3. a filling tube in fluid communication with the eductor, extending from the eductor and adapted to fill a container associated therewith;
4. first means for controlling water flow through the eductor;

(d) a second container filling station for filling containers of a size different than those at the first filling station including:

1. a second selector switch valve;
2. an eductor in fluid communication with the selector switch valve and the water system;
3. a filling tube in fluid communication with the eductor extending from the eductor and adapted to fill a container associated therewith; and
4. second means for controlling water flow through the eductor.

A drain is disposed at the second container filling station, the drain comprising a drain basin and a drain tube removably attached to the drain basin for removing excess liquid.

As contemplated, the first container filling station is used to fill a first size container such as three gallon and larger containers. The first switch or switch valve is used for filling the container with a chemical cleaner from one or more sources. The first selector switch valve may be the "Streamline Select Four" identified before. The selector switch valve is in fluid communication with each of the chemical sources via suitable tubes or hosing. The selector switch valve is also connected to an eductor which is, in turn, connected to the means for delivering water. The pressure created by water moving through the water system and the eductor causes the eductor to siphon or draw chemical from its container to the switch or valve, through a valve delivery port or vacuum tube and, then, into the eductor. The chemical mixes with the water to provide a proper concentration of cleaner to be dispensed into a use container.

The second container filling station also employs a second selector switch valve but substantially reduces cross-contamination. The valve delivery port for a second switch valve has a reduced surface area to minimize residual chemical collection therein.

The filling process at both stations is the same. When the container is in position to be filled, the operator selects the chemical with the selector switch, then activates the means for controlling the flow of water.

The various features, advantages and other uses of the present invention will become more apparent, by referring to the following detailed description and drawing in which like reference numerals designate like parts throughout the figures, in which:

BRIEF DESCRIPTION OF THE DRAWINGS

FIG. 1 is a perspective front view of the mixing and dispensing system hereof;

FIG. 2 is a perspective rear view of the mixing and dispensing system hereof;

DESCRIPTION OF THE PREFERRED EMBODIMENTS

Figure 3:
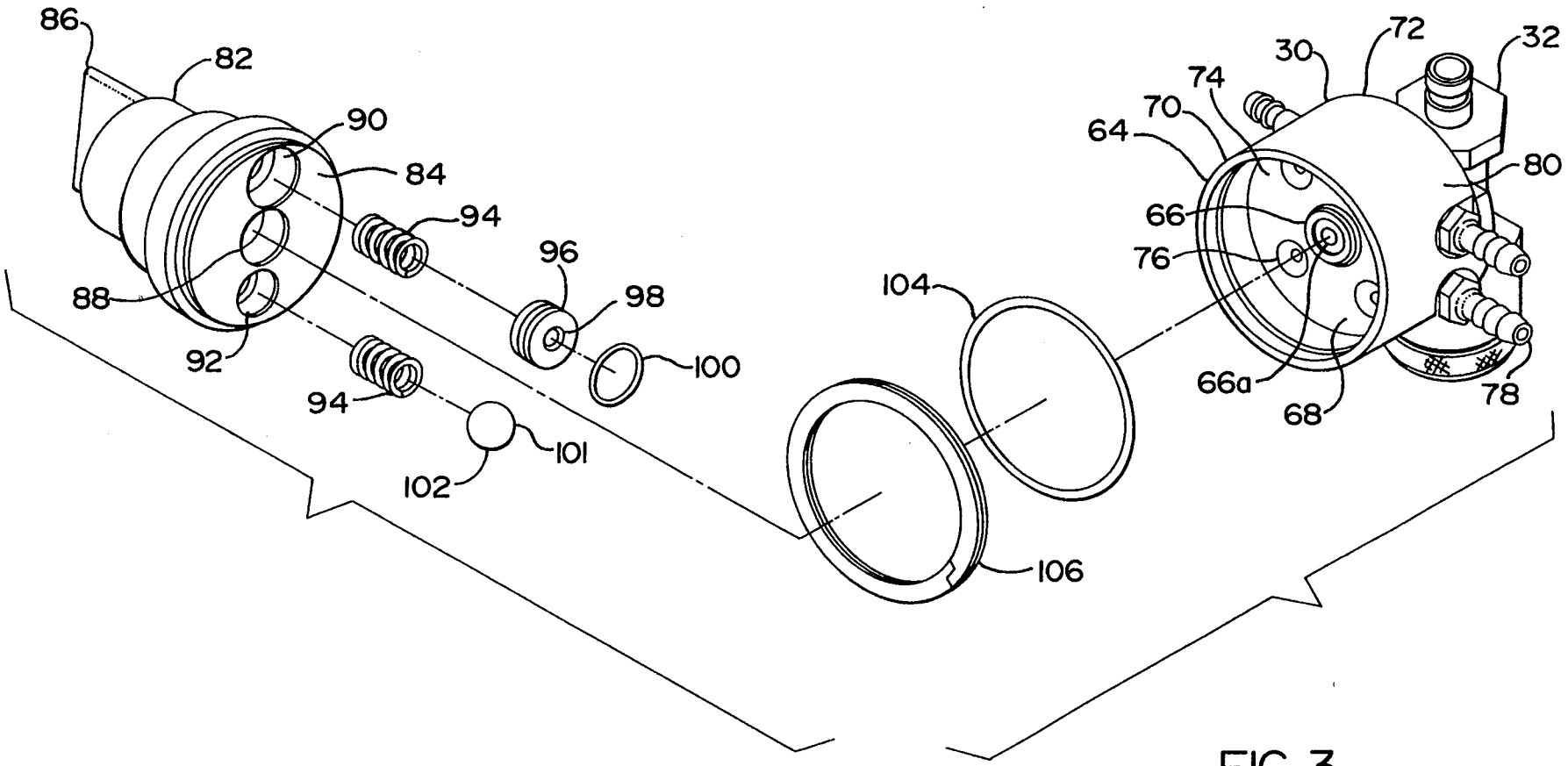
FIG. 3 is an exploded view of the first selector switch valve used herein.
Figure 4:
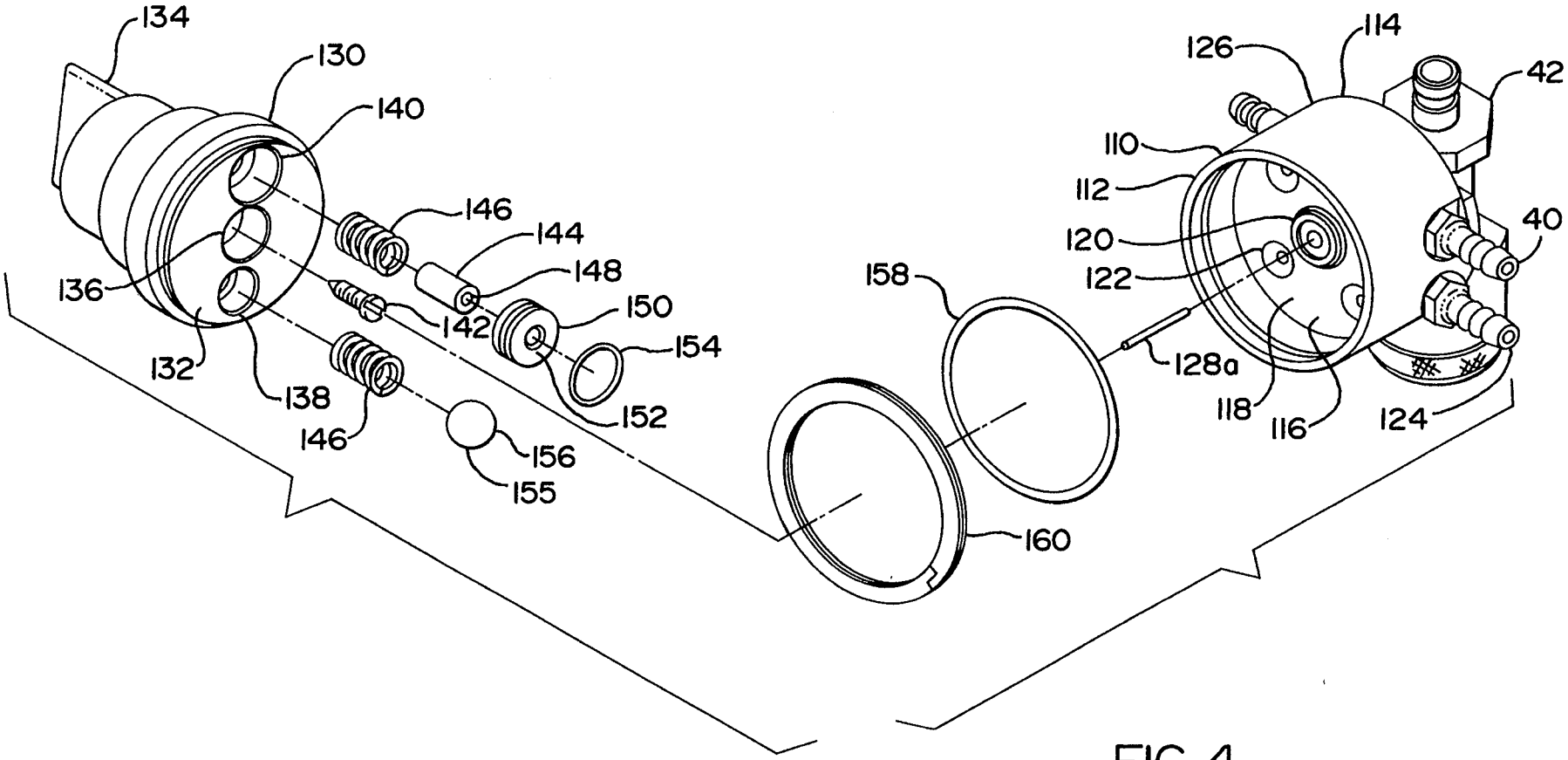
FIG. 4 is an exploded view of the second selector switch valve used herein.

Referring now to the drawings, and, in particular, FIGS. 1–4, there is depicted therein, a first embodiment of mixing and dispensing device of the instant invention, generally denoted a 10. The device 10, generally, comprises:

(a) means 20 for delivering water from a source thereof;

(b) plural sources of chemical, each denoted at 12, and for mixing with the water;

(c) a first container filling station 22 including:

1. a first selector switch or switch valve 30;
2. an eductor 32 in fluid communication with the selector switch valve 30 and the means 20 for delivering water;
3. a filling tube 34 in fluid communication with the eductor 32, extending from the eductor 32 and adapted to fill a container (not shown) associated therewith:
4. first means 38 for controlling water flow through the eductor 32;

(d) a second container filling station 24 for filling containers of a different size than those at the first filling station 22, including:

1. a second selector switch or switch valve 40 having means 41 for minimizing chemical residue collection therein;
2. an eductor 42 in fluid communication with the second filling station selector switch valve 40 and the means 20 for delivering water;
3. a filling tube 44 in fluid communication with the eductor 42 and extending from the eductor 42 and adapted to fill a container (shown in phantom) associated therewith; and
4. second means 60 for controlling water flow through the eductor 42; and The device also includes a drain 46 disposed at the second container filling station 24. The drain 46 comprises a drain basin 48 and a drain tube 50 removably attached to the drain basin 48 for removing excess liquid.

The device 10 is generally used for mixing and dispensing cleaning chemicals from the chemical or liquid containers 12 to both small volume containers and large volume containers used by cleaning personnel. As noted, the device 10 provides for a first container filling station 22 and a second container filling station 24. Each station 22, 24 uses a selector switch valve 30 or 40 to process the contents of the chemical sources 12 through a single filling tube 34 or 44 into a receiving container (only one of which is shown) at each station 30, 40. This substantially reduces the amount of equipment handling and directly fills the container that will be used by cleaning or janitorial personnel.

The mixing and dispensing device 10 is preferably mounted to support panels 26 which are usually attached to a stand 14 and as discussed in more detail below.

When the selector switch valves 30 or 40 are switched, after dispensing a first chemical, to a position for dispensing a second or other chemical, residue from the first chemical will be present within the valves. The residue of the first chemical usually contaminates the second chemical. This cross-contamination does not significantly effect large volumes of cleaning product. The large volumes of the second chemical and water dilutes the first chemical sufficiently to meet Federal guidelines for cross-contamination. However, the cross-contamination of chemicals does seriously impact upon small volumes of cleaning product because there is not sufficient volume of a second chemical and water to dilute the first chemical within the range of Federal guidelines. To prevent this, the means 41 for minimizing residue collection in the second selector switch valve 40 preferably includes a reduced internal surface area portion which is discussed in greater detail below.

Thus, the preferred embodiment hereof the device 10 has a first filling station 22 where cross-contamination is not a problem and a second filling station 24 which minimizes cross-contamination. Each station 22, 24 is, preferably, operated by water, under pressure. The water is provided through the means 20, from a source (not shown). The means for delivering 20 comprises an inlet valve 56, 58 and, preferably, a pair of hoses 58, 58'. The inlet 56, 58 delivers water from the source. One hose 58 is connected to the inlet valve 56 at one end and the eductor 32 for the first selector switch valve 30 at the opposite end. The second hose 58' is connected to the inlet valve 56 at one end and the eductor 42 for the second volume selector switch valve 40 at the opposite end.

The first container filling station 22 includes the first selector switch 30 which is mounted to a support panel 26, such as by threaded fasteners or the like or by any other suitable means (not shown).

As shown in FIG. 3, the valve 30 comprises a valve base 64. The valve base 64 has a first end 70 and a second end 72. A seating cavity 68 is formed in the base 64 proximate the first end 70 and partially extends to a recessed wall 74 provided in the base 64, as shown. The recessed wall 74 defines a stop for a selector knob 82 as described below. The valve base 64 also has a side wall 80 which surrounds the seating cavity 68 and defines the outside surface of the valve base 64. A plurality of tube fittings 78 are removably mounted to or integrally formed with the wall 80 of the valve base 64.

There is at least one access hole 76 for delivering chemical therethrough, preferably a plurality, formed in the recessed wall 74. The access hole 76 is in fluid communication with the tube fitting 78.

A vacuum tube 66, preferably a Venturi tube for creating a vacuum to draw chemical from the sources thereof axially extends through the valve base 64. The Venturi tube 66 is removably attached to the eductor 32 at one end. The opposite end extends beyond the recessed wall 74 and into the seating cavity 68 of the valve base 64. The Venturi tube 66 has a longitudinal hole **66*a*** formed therethrough.

The valve 30 is also comprised of a selector switch knob 82. The switch knob 82 has a seating end 84 and a gripping end 86. The seating end 84 of the switch knob 82 has an axially located center cavity 88 formed therein and which extends partially into the switch knob 82. A first cavity 90 is formed adjacent the center cavity 88. A second cavity 92 is also formed adjacent the center cavity 88 and in line with the center cavity 88 and the first cavity 90 across the seating end 84. The center cavity 88 is in fluid communication with the first cavity 90 and the Venturi tube 66.

The selector switch knob 82 seats in the seating cavity 68 of the valve base 64 and abuts against or is near the wall 74. The switch knob generally includes:

(a) a pair of springs 94 each of which is insertable into an associated cavity 90, 92 of the switch knob 82;

(b) a bushing 96 with a hole 98 formed therethrough and an 0-ring 100 surrounding the bushing 96, the bushing 94 being insertable into and in fluid communication with the first cavity 90 and the access hole 76 in the valve base 64, the bushing 96 urging against the spring 94 and the recess wall 74 surrounding the access hole 76 in the valve base 64; and;

(c) means 101 for maintaining alignment between the first cavity 90 and a selected access hole 76, the means preferably comprising a ball 102 which is inserted on top of the spring 94 in the second cavity, the ball 102 urges against the spring 94 and the selected access hole 76 in the valve base 64.

The switch knob 82 is assembled to the valve base 64 over the Venturi tube 66 which enters the center cavity 88 of the switch knob 82. A seal 104 precedes the knob 82 into the valve base 64. A snap ring or retainer 106 secures the switch knob 82 to the valve base 64.

In use, because of the positioning of the access holes 76, as the knob is rotated to a desired position, the ball will seat in another access hole to, thus, both seal off the non-used hole or port and simultaneously align the first cavity with the in-use port 76 formed in the wall 74.

The Venturi tube 66 of the selector switch valve 3O is removably connected to the eductor 32 which, in turn, is removably connected to the filling tube 34 at one end and the water hose 58 of the water system at the other end. As noted, the tube fitting 78 of the switch valve 30 is connected to a chemical container delivery tube 18.

The first volume selector switch valve 30 as described above is commercially available from Hydro Systems Company of Cincinnati, Ohio and is marketed under the name "Hydro Streamline Select Four".

The second filling station 24 for filling containers smaller than those at the first filling station includes a second selector switch or switch valve 40, adapted for substantially reducing cross-contamination between the chemicals. As shown in FIGS. 4, 8, 9 and 10, the second volume selector switch valve 40 comprises a valve base 110. The valve base 110 has a first end 112 and a second end 114. The valve base 110 has a seating cavity 116 formed therein, proximate the first end 112, which partially extends into the valve base 110 and terminates at a recess wall 118 for seating a selector knob 130, as described below. The seating cavity 116 is surrounded by a side wall 126. A plurality of tube fittings 124 are removably attached to or integrally formed with the side wall 126 of the valve base 110. The recess wall 118 has a plurality of access holes 122 formed therein. The access holes 122 are in fluid communication with the tube fittings 124 and delivers chemical therethrough.

Figure 8:
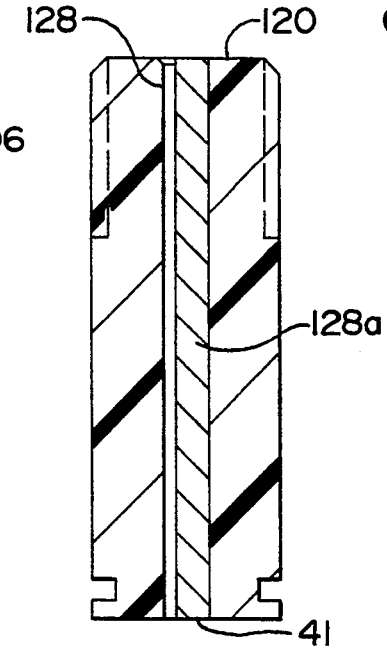
FIG. 8 is a cross-sectional view of the Venturi tube used with a first embodiment of the second selector switch valve.
Figure 5:
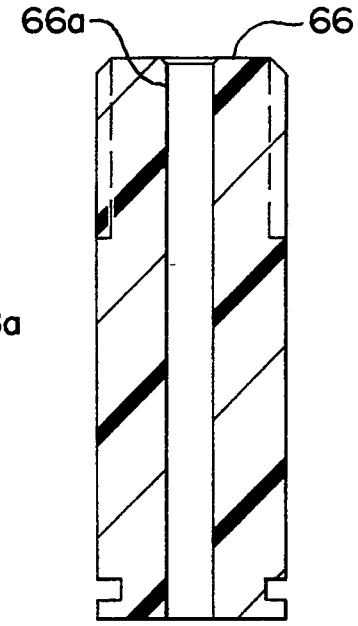
FIG. 5 is a cross-section view of a Venturi tube used with the first selector switch valve.

As shown in FIGS. 5 and 8, a vacuum tube 120 for creating a vacuum to draw chemical from the source thereof axially extends through the recess wall 118. One end of the vacuum tube 120 extends beyond the second end 114 of the valve base 110 and is connected to eductor to deliver chemical thereto. The opposite end extends beyond the recess wall 118. The Venturi tube 120 has a substantially reduced diameter longitudinal bore 128 formed therethrough or, alternatively, has a plug **128*a* inserted thereto, to reduce the surface area of the bore 128 where residual chemical would otherwise collect. The reduced diameter bore 128** has a diameter sufficient to permit flow but has a reduced surface area for liquid residue to collect.

The second selector switch or switch valve assembly 40 also includes a selector switch knob 130. The selector switch knob 130 has a seating end 132 and a gripping end 134. The switch knob 130 has an axially disposed center cavity 136 formed therein. The knob 130 has a first cavity 138 formed therein disposed near the center cavity 136 and in fluid communication therewith. Also, the knob 130 has a second cavity 140 formed therein, disposed near the center cavity 136, preferably the cavity 140 is axially aligned with the center cavity 136 and first cavity 138.

Figure 9:
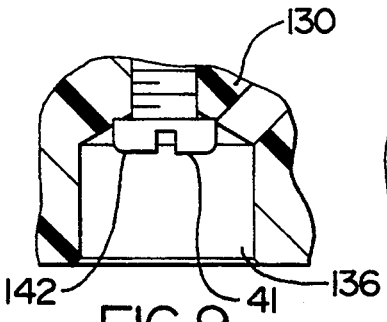
FIG. 9 is a partial cross-sectional of the center cavity of the first embodiment of the second selector switch valve.
Figure 6:
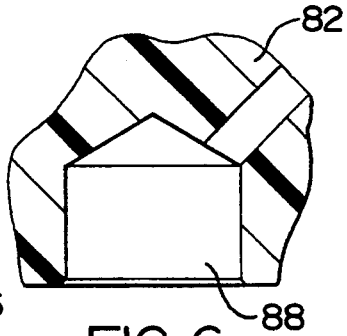
FIG. 6 is a partial cross-sectional view of the center cavity of the first filling station selector switch valve knob.

As shown in FIGS. 6 and 9, a plug 142 or filler is inserted into the center cavity 136 of the knob. The plug 142 reduces the surface for collecting liquid residue without interfering with the fluid communication to the first cavity 137, thus reducing cross-contamination and, thus, defines the means 41 for minimizing residue collection. The plug 142, also, does not interfere with the liquid flow through the Venturi tube 120, which also projects into the cavity 136, as shown.

Figure 7:
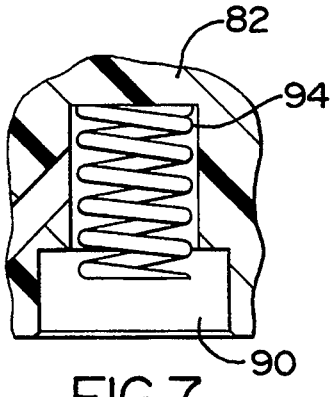
FIG. 7 is a partial cross-sectional view of the first cavity of the first selector switch valve used herewith.

The selector switch knob 130 also includes a spring 146 and a flow tube or insert 144. The flow tube 144 is fitted into the spring 146. The spring 146 and tube 144 are installed into the first cavity, as shown in FIGS. 7 and 8. The flow tube 144 is adapted to limit the liquid flow through the first cavity 138 to the center cavity 136 and reduces the surface for liquid residue to collect. The flow tube 144 has a longitudinal bore 148 formed therethrough to direct flow through the tube 144, from an access hole or port to the center cavity 136.

Additionally, the knob 130 has a bushing 150 which is inserted into the first cavity 138. The bushing 150 seats on top of the spring 146 and flow tube 144 and is in fluid communication through an aperture 152 with the flow tube 144 and the access hole 122 of the valve base 110 when the valve 40 is assembled. The bushing 150 is surrounded by an O-ring 154. The bushing 150 is urged by the spring 146 against an aligned across hole 122 in the recessed wall 118 in the valve base 110 to direct flow therethrough and to seal off any flow into the base.

By virtue of the reduced surface in the Venturi tube 120 and the center cavity 136, along with the flow tube 144 the amount of liquid residue remaining in the valve 40 is minimized. This, then, reduces cross-contamination because the liquid remaining in the valve is sufficiently diluted by the water and new chemical to meet existing Federal guidelines.

As with the first selector switch valve 30, the selector switch knob 130 of the second selector switch valve 40 also has a means 155 for maintaining alignment between the first cavity and the selected access hole. The means 155 preferably comprising a ball 156 which inserted into the second cavity 140 and seats on a spring 146 before assembly. The ball 156 urges against the spring 146 and seats in art access hole 122 in the valve base 110 and functions as described hereinabove. Also, the valve 40 has a seal 158 which is insertable into the seating cavity 116 of the valve base 110. A snap ring or retainer 160 is insertable into the cavity 116 to hold the knob 130 in place after the switch knob 130 is seated in the seating cavity 116 and urging against the seal 158. The valve 40 is, preferably, made from chemical resistant metal and plastic.

Figure 11:
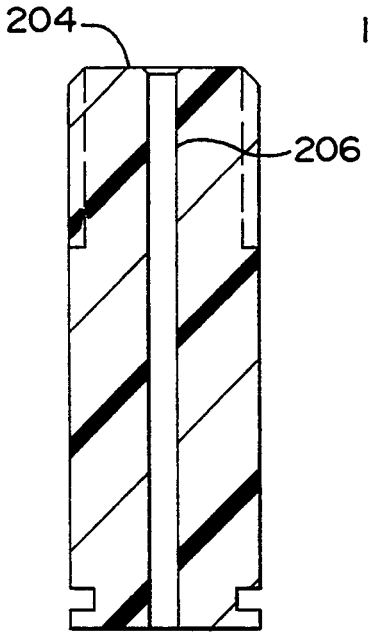
FIG. 11 is a cross-sectional view of a Venturi tube used with a second embodiment of the second selector switch valve.
Figure 12:
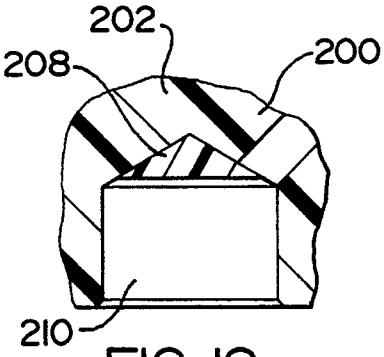
FIG. 12 is a partial cross-sectional view of the center cavity of the second embodiment of the second selector switch valve.
Figure 13:
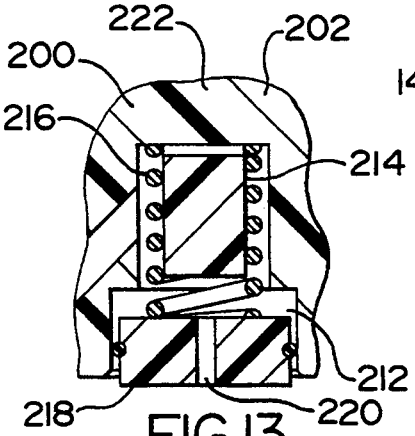
FIG. 13 is a partial cross-sectional view of the second cavity of the second embodiment of the second filling station selector switch.
Figure 10:
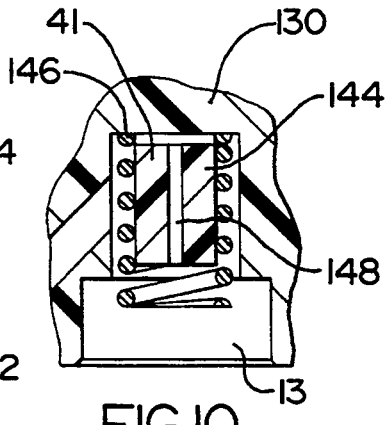
FIG. 10 is a partial cross-sectional view of the second cavity of the first, embodiment of the second selector switch valve.

In a second embodiment of the second selector switch valve 200 is shown in FIGS. 11, 12 and 13. This switch valve 200 is substantially similar to the first embodiment. According to the embodiment, a vacuum tube 204, is disposed within a valve 200. The Venturi tube has a bore 206 formed therethrough which has a diameter sufficient to permit flow but has a reduced surface area for liquid residue to collect. A plug or filler 208, is disposed in a center cavity 210 of the selector switch knob 222 to substantially reduce the surface area exposed to liquid after the Venturi tube 204 is inserted. A solid plug or insert 214 and a spring 216, are inserted into a first cavity 212 of the knob 222. A bushing 218 is insertable into the first cavity 212 of the knob 222 on top of the spring 216 and plug 214. The bushing 218 has a hole 220 formed therethrough. The hole 220 has a diameter sufficient to permit flow but a surface area for collecting residue.

As shown in FIGS. 1 and 2, and as noted above, the present dispenser is mounted into a stand 14. The stand includes support panels 26. The stand including the panels 26 are made from chemical resistant plastic or metal such as stainless steel. The stand further comprises a plurality of vertical legs **26*a* and a plurality of tiers 16 attached to the support legs 26*a*. At least one tier 16 has liquid container 12 disposed thereon. Another tier 16 has the support panels 26 attached thereto. Although not shown, wheels or castors may be provided on the legs to provide mobility to the stand 14**.

Using the first container filling station 22, the operator places the filling tube 34 in a large container. The operator then selects, by rotating the selector switch valve 30, the desired chemical container. The operator then activates the water flow through the eductor 32 via a push-button 38 or the like to flow into a container provided. The pressure of the water causes the eductor 32 to siphon desired chemical through the valve 30 from a desired access hole, into the first cavity, and, then, through the Venturi into the eductor to mix with the water through the eductor and, then, the mixed chemical flows. When the container is full, the operator releases the button.

Using the second container filling station 24, an operator places a small container into the drain basin 48 of small container filling station 24. The operator inserts the filling tube 44 into the container and selects the desired chemical with the selector switch valve 40. After the chemical has been selected, the operator urges the container against the push-button 60. This activates the flow of water through the eductor 42 which in turn siphons the chemical through the valve 40 and into the container with the water, in the same manner described above. When the container is full, the operator withdraws the container and deactivates the water flow. Excess liquid, if any, is drained away by the drain apparatus.

The instant invention greatly enhances the handling of cleaning chemicals the mixing and dispensing of those chemicals into containers of all sizes for use by cleaning personnel. By providing one device 10 to process varying size containers, the instant invention greatly reduces handling of chemicals, reduces operator involvement in the process and provides for cleaning products that comply with Federal guidelines.

It should be noted with respect hereto that the means for controlling the water flow through each eductor is a commercially available structure ordinarily incorporated into the eductor, per se. As is known, such means for controlling includes a means for actuating, such as a spring-loaded push-button 38 or 60 mounted on a panel 26 and a dam or gate (not shown) disposed into the eductor. Actuation or depression of the button moves the gate to permit flow therepast in the known manner.

Also, it is possible to provide a meter or metering pin in the flow line or Venturi to meter the flow of chemical into the eductor. Again, this is known to the skilled artisan.

Likewise, it is possible to build a single filling site device comprising solely what has been described herein as the second filling station. Moreover, although the present invention has been described with respect to means for delivering water, it is contemplated that other liquids may be used, such as liquid solvent and the like. Likewise, a pre-mixed solution to which a second chemical is to be added may be used as the educting fluid in lieu of water.

Also, while the second selector switch has been described as being used with the second filling station, it is usable at the first filling station as well.

Having, thus, described the present invention, what is claimed is:

1. A mixing and dispensing device for liquids comprising:

(a) means for delivering a liquid;

(b) plural sources of chemicals to be mixed with the liquid;

(c) a first container filling station including:

(1) a first selector switch valve;

(2) an eductor in fluid communication with the first selector switch valve and means for delivering;

(3) a filling tube in fluid communication with the eductor and extending from the eductor and adapted to fill a container associated therewith;

(4) means for controlling liquid flow through the eductor;

(d) a second container filling station for filling containers of a size different than the first filling station including:

(1) a cross-contamination reducing second selector switch valve having means for minimizing chemical residue collection therein;

(2) an eductor in fluid communication with the second selector switch valve and the means for delivering;

(3) a filling tube in fluid communication with the eductor, extending from the eductor and adapted to fill a container associated therewith; and (4) means for controlling the liquid flow through the eductor.

2. The device of claim 1 which further comprises:

a drain disposed at the second container filling station, the drain comprising a drain basin and a drain tube removably attached to the drain basin for removing excess liquid.

3. The mixing and dispensing device of claim 1 wherein the first selector switch valve comprises:

(a) a valve base, having a first end and a second end, the valve base having a seating cavity partially formed therein proximate the first end, a recess wall disposed in the base, the recess wall having a plurality of access holes formed therein, each for delivering a chemical to the eductor, a plurality of tube fittings removably attached to the base, the fittings being in fluid communication with an associated access hole;

(b) a vacuum tube having a first end and a second end, the vacuum tube extending through the valve base, the first end of the vacuum tube extending beyond the recess wall of the valve base and the second end of the vacuum tube extending beyond the second end of the valve base, the vacuum tube having a longitudinal hole formed therethrough for delivering a chemical to the eductor; and (c) a rotatable selector switch knob seating in the seating cavity of the base, to selectively maintain fluid communication between one of the plural sources and the eductor, the vacuum tube extending into the switch knob, and delivering a chemical from an access hole, through the knob and into the eductor, and means for maintaining alignment between the first cavity and the selected access hole.

4. The mixing and dispensing device of claim 1 wherein the second selector switch valve comprises:

(a) a valve base, having a first end and a second end, the valve base having a seating cavity partially formed therein proximate the first end, a recess wall disposed in the base, the seating cavity extending from the first end to the recess wall, the recess wall having a plurality of access holes formed therein, each for delivering a chemical to the eductor, a plurality of tube fittings removably attached to the base, the fittings being in fluid communication with an associated access hole;

(b) a vacuum tube having a first end and a second end, the vacuum tube extending through the valve base, the first end of the vacuum tube extending beyond the recess wall of the valve base and the second end of the vacuum tube extending beyond the second end of the valve base, the vacuum tube having a longitudinal hole formed therethrough; and (c) a rotatable selector switch knob having a seating end and a gripping end of the knob seating in the seating cavity of the base, the knob having a center cavity formed therein, a plug insertable into the center cavity to reduce the surface area thereof, the vacuum tube extending thereinto, a first cavity in fluid communication with the center cavity, an insert disposed in the first cavity to direct flow from the first cavity to the center cavity, the insert and plug defining the means for minimizing chemical residue collection, and means for maintaining alignment between the first cavity and a selected access hole.

5. The mixing and dispensing device of claim 1 wherein the first means for controlling liquid flow is an openable and closable gate disposed in the eductor.

6. The mixing and dispensing device of claim 1 wherein the second means for controlling liquid flow is an openable and closable gate disposed in the eductor.

7. The mixing and dispensing device of claim 1 further comprising a stand.

8. The mixing and dispensing device of claim 7 wherein the stand comprises:

(a) a plurality of vertical legs;

(b) a plurality of horizontal tiers, the tiers mounted to the legs, at least one tier having the sources for chemicals disposed thereon and another tier having the support panels attached thereto.

9. The mixing and dispensing device of claim 1 wherein the means for minimizing chemical residue collection comprises:

a reduced internal surface area portion provided in the second selector switch valve.

* * * * *